US006270368B1

(12) United States Patent
Duval

(10) Patent No.: US 6,270,368 B1
(45) Date of Patent: Aug. 7, 2001

(54) CONNECTION DEVICE WITH PERPENDICULAR INTERLOCKING TIGHT CONNECTOR WITH DOUBLE LOCKING OBTAINED

(75) Inventor: Frederic Duval, Aviron (FR)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/300,171

(22) Filed: Apr. 27, 1999

(51) Int. Cl.[7] ..... H01R 4/60
(52) U.S. Cl. ..... 439/211; 439/372; 439/595
(58) Field of Search ..... 439/857, 216, 439/211, 209, 121, 110, 214, 249, 595, 372, 638

(56) References Cited

U.S. PATENT DOCUMENTS 4,453,799 * 6/1984 Inoue ..... 439/861
4,897,048 * 1/1990 Liebon et al. ..... 439/211
5,192,217 * 3/1993 Wittmer ..... 439/211

* cited by examiner

*Primary Examiner*—Brian Sircus
*Assistant Examiner*—Michael C. Zarroli
(74) *Attorney, Agent, or Firm*—Perman & Green, LLP

(57) ABSTRACT

An electrical connection device with perpendicular Interlocking of a male part. The male part comprising at least one electrical connection contact with elastic blades forming a clamp and arranged in a contact-bearing casing. The male part is arranged, into a female part comprising at least one contact in the form of a blade. The male elastic blades forming a clamp of the contact or contacts coming to be positioned on both sides of the thickness of the corresponding blade of contact of the female part. The invention also covers the connector equipped with this device.

21 Claims, 5 Drawing Sheets

CONNECTION DEVICE WITH PERPENDICULAR INTERLOCKING TIGHT CONNECTOR WITH DOUBLE LOCKING OBTAINED

BACKGROUND OF THE INVENTION

Field of the Invention

The present invention concerns a device for perpendicular connection between two elements, as well as the tight connector and the double locking obtained.

In the connector field, and more particularly in the automobile field, connection devices have been sought that permit establishing reliable electrical connections, at the lowest cost, and which are demountable, generally one of the parts being part of a fixed network and the other able to be removed in order to be replaced.

Additional constraints are numerous, since it is necessary that such connection devices support vibrations without losing the contact pressure that assures electrical continuity, that they are mounted easily without errors being able to occur during positioning, that they are tight and that they are mechanically locked with great reliability.

Moreover, it is noted that these connection devices are frequently situated in difficultly accessible places, which requires the designer to create particular connection configurations.

Therefore, in the case where the parts to be connected are arranged along perpendicular planes, difficulty is increased by the respective movements of the two elements during vibrations or shocks, since the courses and directions of the forces to which they are subjected are often complex, even opposed.

The connection device must preferably be tightly sealed when it is used in an automobile engine compartment and preferably comprise a double locking to assure holding in position, even under extreme conditions.

SUMMARY OF THE INVENTION

The present invention seeks to alleviate these disadvantages, and the connection device according to the invention is reliable, has a manufacturing cost compatible particularly with the prices of furnishings for the automobile market, [and] an easy and rapid mounting without possibility of error during said mounting. This device also assures a reliable mechanical connection and an easy demounting.

According to the invention, the electrical connection device with perpendicular interlocking of a male part comprising at least one electrical connection contact with elastic blades forming a clamp, arranged in a contact-bearing casing with a female part comprising at least one contact in the form of a blade, borne by a base, said elastic blades forming a clamp with the contact or contacts coming to be positioned on both sides of the thickness of the corresponding contact blade of the female part.

BRIEF DESCRIPTION OF THE DRAWINGS

More particularly, the contact or contacts are made up of a bare zone of a metal strip elongated in a direction perpendicular to the axis of interlocking of the male part into the female part. This metal strip for the contact or contacts is Inserted into an insulating base which has been molded, the bare zone corresponding to an empty space in said molding.

More specifically, the device comprises at least two metal strips, these two juxtaposed metal strips being separated from each other by an insulating partition molded with the insulating base.

According to another characteristic, each blade of the contact or contacts of the female part comprises a contact surface defined by two transversal folds that permit an off-setting of said surface with regard to the longitudinal axis of the base.

DETAILED DESCRIPTION OF THE PREFERRED EMBODIMENT

The contact-bearing casing comprises the first and second locking means of the female contact or contacts onto each corresponding blade.

The invention also has for a subject the corresponding electrical connector, with perpendicular interlocking, which comprises a matrix in which the base and contact assembly of the female part is integrated, said matrix being provided with a housing of conjugate profile to the head of the casing bearing the contacts and sealing means.

Joints assure the tight seal of the assembly after interlocking.

Moreover, means for clamping the male and female parts secure the joining.

Figure 1:
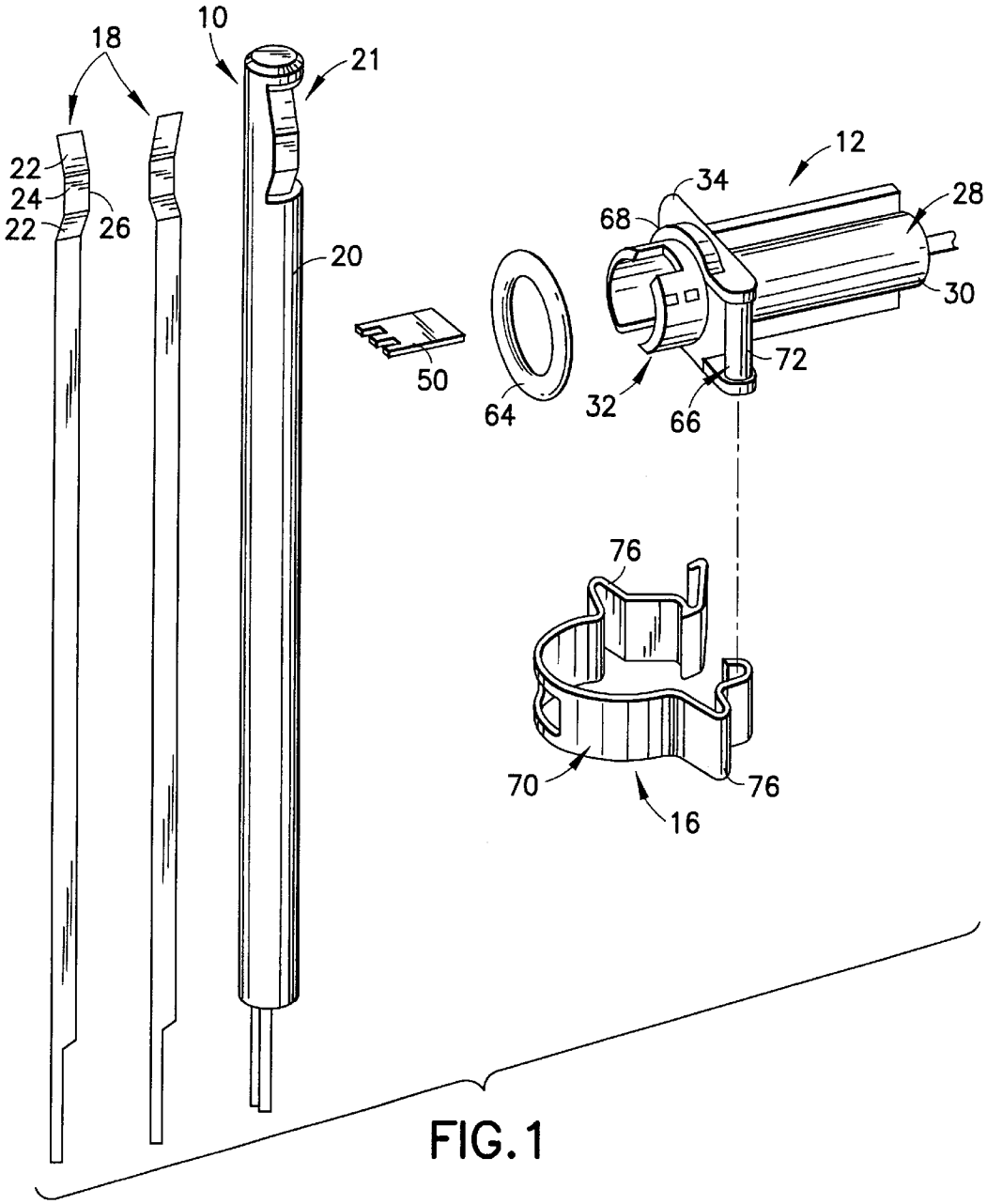
Figure 2A:
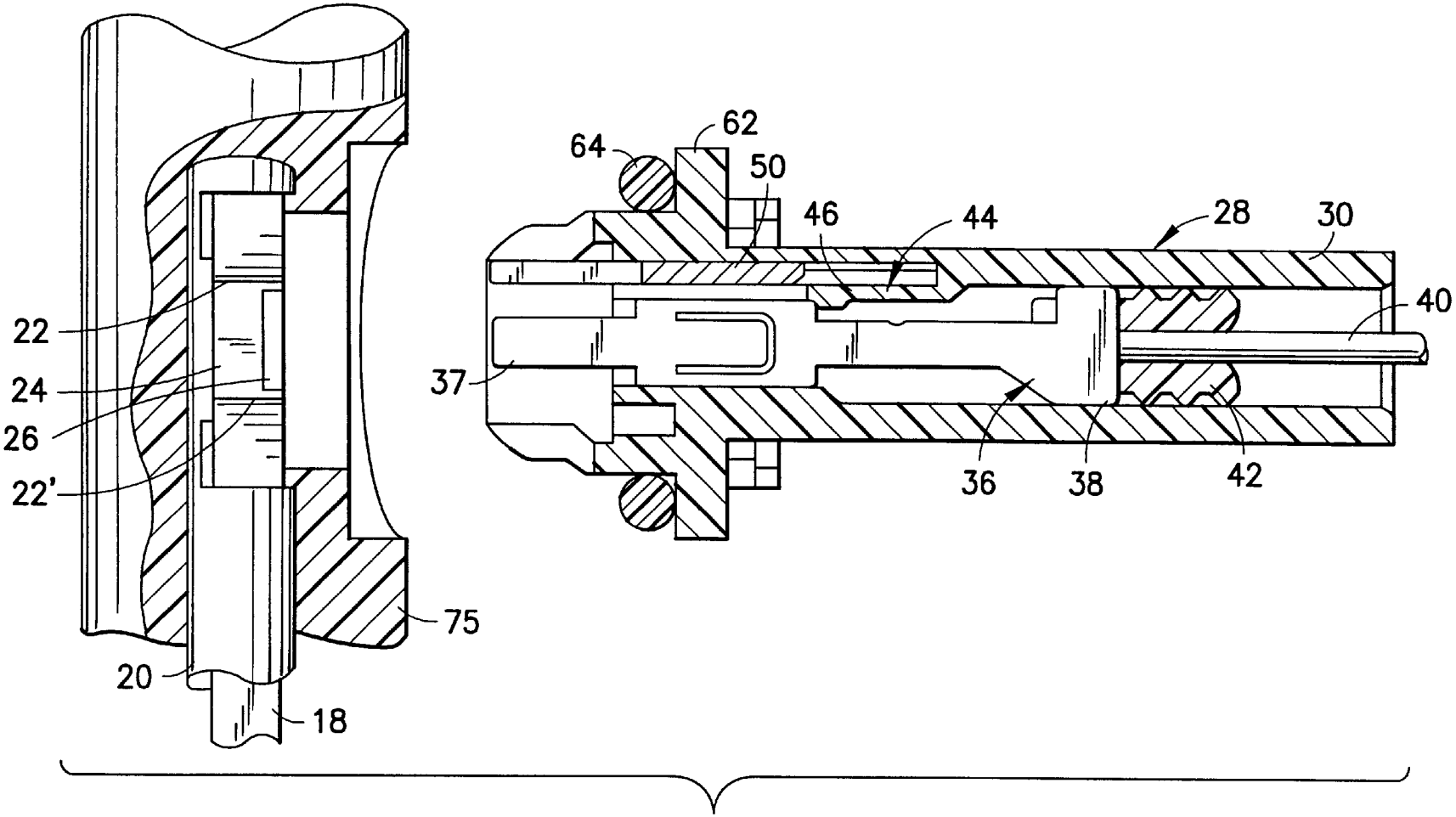
Figure 2B:
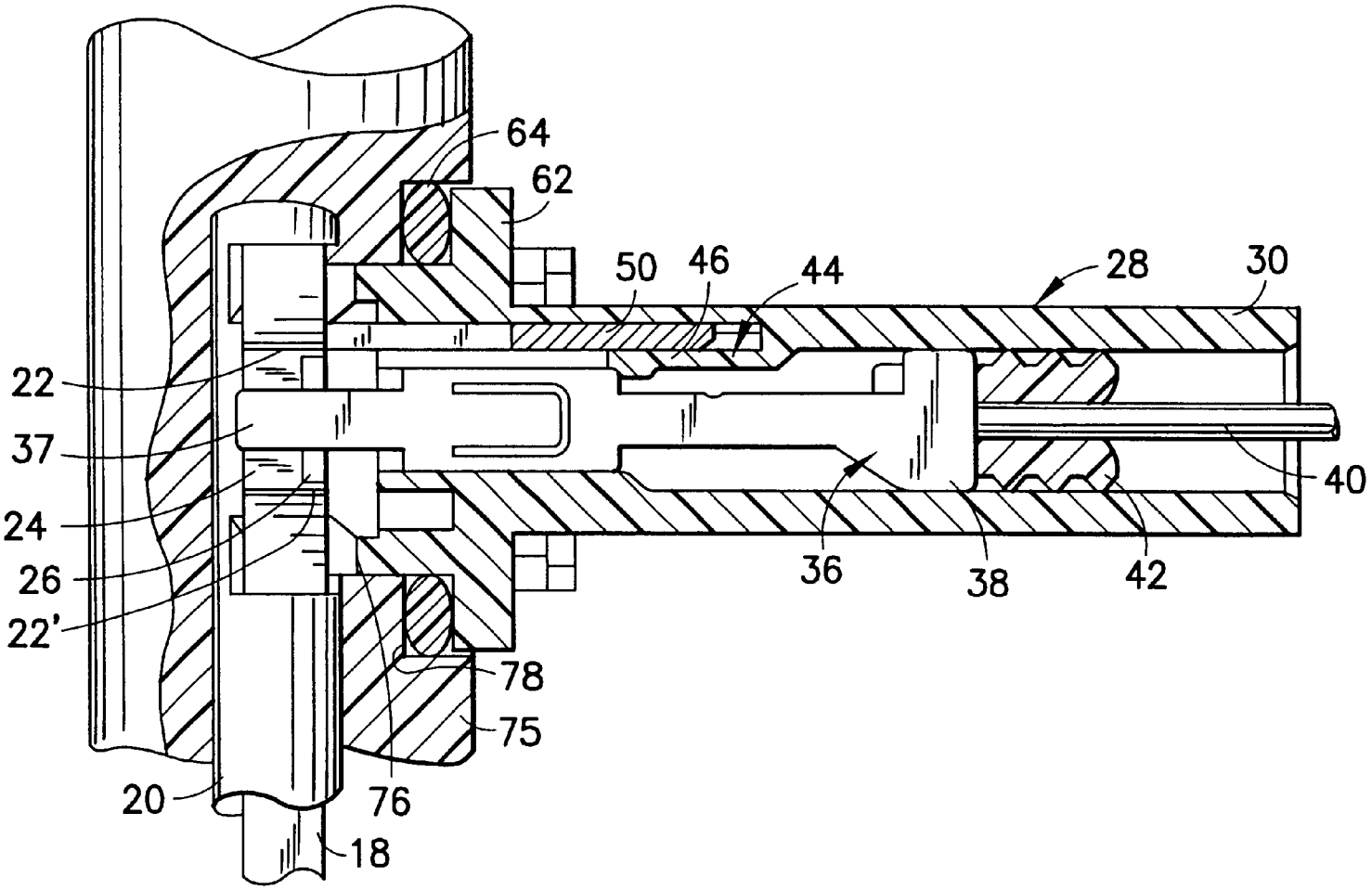
Figure 3:
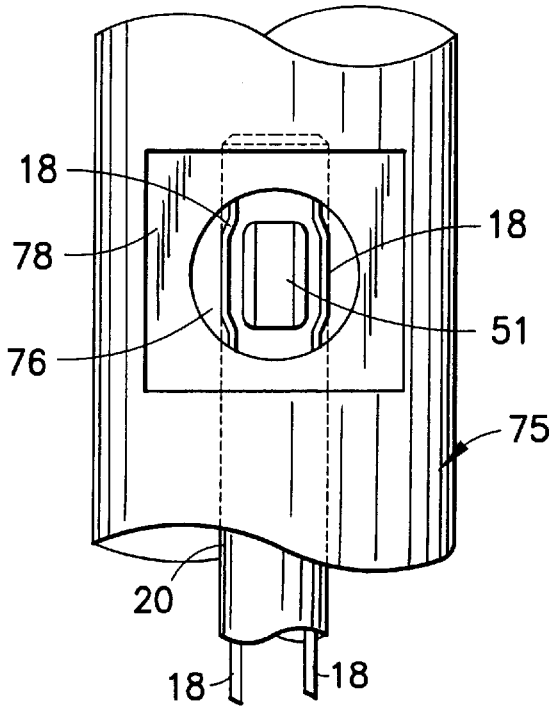
Figure 4:
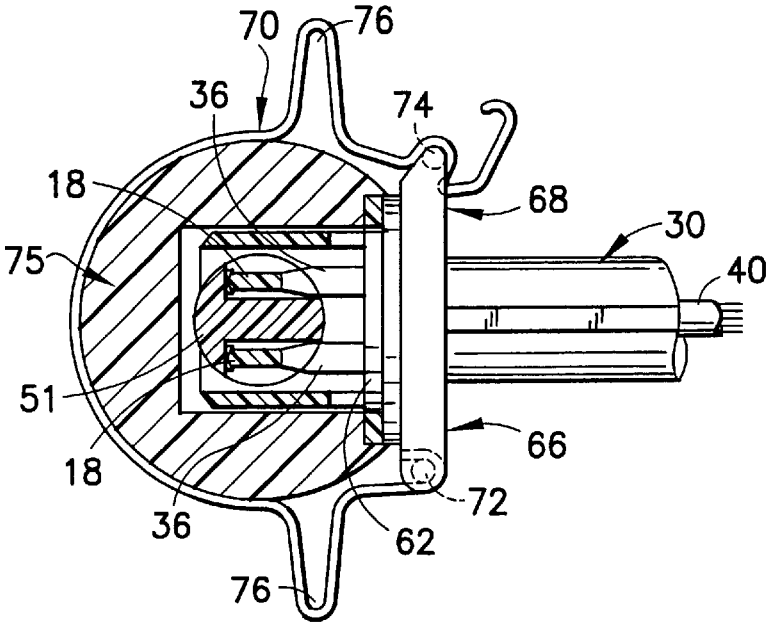
Figure 5:
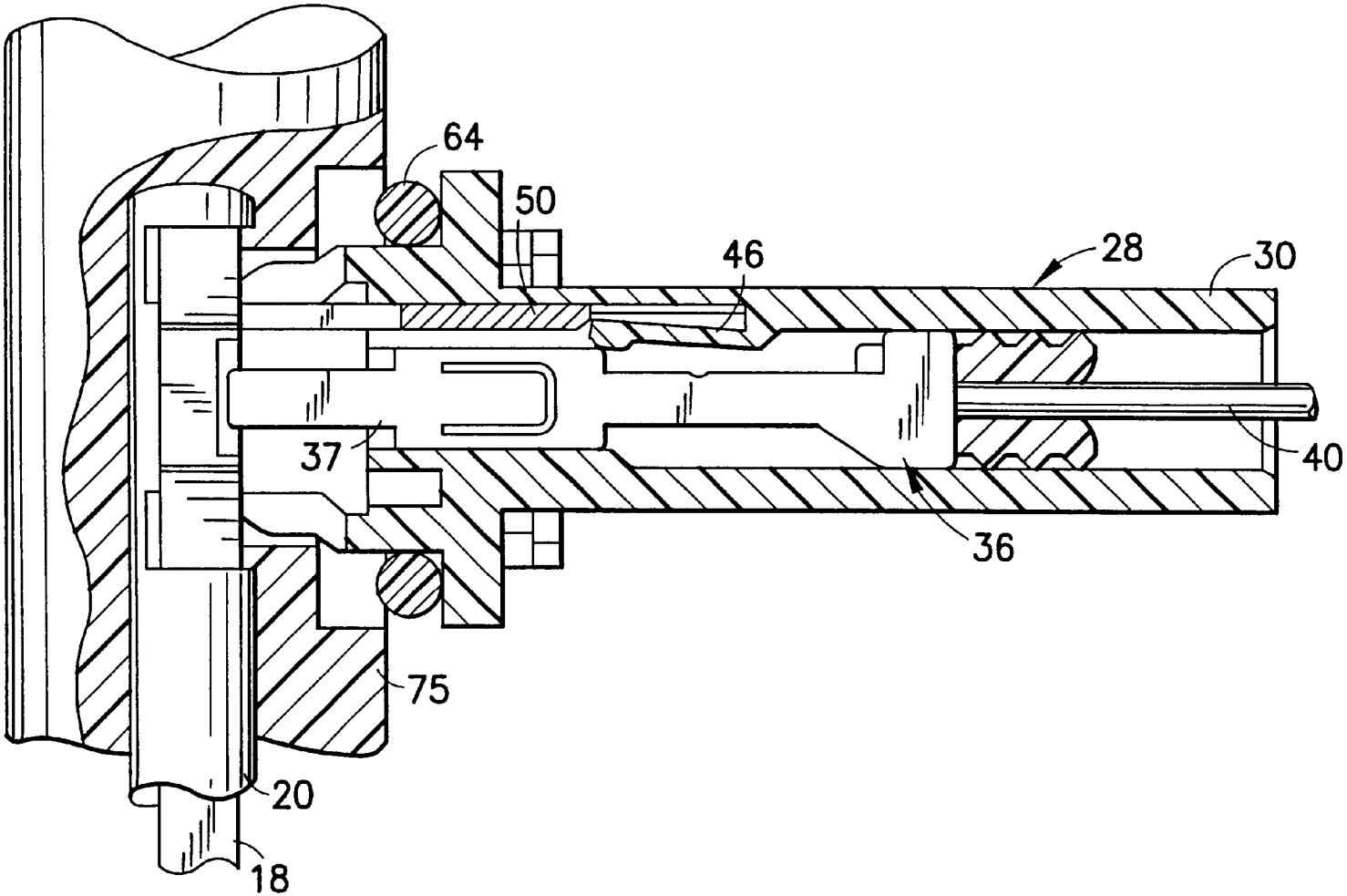

The invention is now described with regard to the attached drawings according to a particular mode of embodiment, non-limiting, the different figures of the drawings showing:

FIG. 1, an exploded perspective view of the male and female parts to be connected in the particular case of a connection device, FIGS. 2A and 2B, two views in longitudinal section, respectively of the pre-introduction and complete introduction positions for the male part into the female part, in the case of a connection with a correct clicking in, FIG. 3, a view of the face of the female part, before presentation of the male part, FIG. 4, a sectional view along line 4—4 of FIG. 2B, to show the arrangement of the different pieces, and FIG. 5, a view of a case of connection with defective clicking in.

In FIG. 1, a connection device is shown comprising a female part 10 and a male part 12, provided to cooperate by clicking In, one with the other, tight sealing means 64 and clamping means 16.

The female part 10 comprises two contacts 18, each in the form of a blade, held in an insulating base 20. This blade is made in a metal strip elongated in a direction perpendicular to the connection axis.

This base is advantageously of plastic molded onto most of the blades except for an empty space during molding, defining a bare connection zone 21 where contact blades 18 are released. It is noted that for better comprehension, the contacts are shown twice in FIG. 1, one outside the base and the other integrated into the base but only one pair of contacts is required for the mode of embodiment shown.

In the mode of embodiment shown in FIG. 1, each contact blade 18 comprises two transversal folds 22, 22' which determine for each a swelling or flattened area 24, thus defining two contact surfaces having on one of their common edges a thin lip 26 facilitating the introduction of a complementary contact described later. This swelling or flattened area is offset with regard to the longitudinal axis of the base to form a projection permitting a free access to each of the surfaces thus defined.

Male part 12 comprises a contact-bearing housing 28 with a socket 30, a front end 32 and means 34 for receiving clamping means 16.

In order to describe the elements borne by the body and the head, one refers to FIGS. 2A and 2B in which the identical elements bear the same references.

Sockets 30 of contact-bearing casing 28 receive two female contacts 36, only one of them being visible in FIG. 2B, a longitudinal sectional view.

In the mode of embodiment shown, each female contact 36 comprises, at the front, elastic blades 37 forming a clamp, generally by bending and provided to cooperate with the surfaces of flattened area 24 of contact 18, in clicked-in position as will be explained later. One observes that blades 18 are clearly oriented perpendicular to the axis of interlocking of contact-bearing casing 28.

Each of contacts 36 is extended, at the rear, by a zone 38 for connecting with an electrical wire 40. To the right of this zone 38, the device advantageously has a tight sealing joint 42.

Each of contacts 36 Is immobilized in socket 30 of the contact-bearing casing by a first locking means 44.

This first locking means comprises a catch 46 which can take a first position in which it is raised, as is seen in FIG. 5, to allow the contact to pass, and a second position in which it is straight so as to immobilize the contact in socket 30.

A second locking means is also provided, which is connected in its functioning to first means 44. This second means comprises a plate 50, which can move in translation relative to socket 30, between a first position, on the front, to come to abut onto the female part as will be explained later, and a second position, on the rear, after clicking in, to come to be housed between the inner surface of socket 30 of the contact-bearing casing and catch 46 so as to prevent the raising of the latter, thus constituting a double locking of each contact.

Head 32 has a cylindrical profile whose central part has been cut away to permit the passage of insulating base 20.

Socket 30 of the contact-bearing casing also has an annular flange 62 designed to receive an o-ring 64, which constitutes tight sealing means 64 between the male and female parts.

As is shown in FIGS. 1 and 4, clamping means 16 comprise two lateral pins 66 and 68 arranged on either side of socket 30 of the contact-bearing casing and an attachment clamp 70.

First pin 66 is made up of an axle 72 around which one of the ends of the attachment clamp can pivot and second pin 68 is made up of a stud 74 with conjugate profile to the free end of the clamp to assure an elastic locking.

This attachment clamp 70 comprises two flanges 76 bent into a V to assure clamping by means of elastic recoil of the male part onto the female part, while permitting the light sealing means, a flattening of sealing o-ring 64 in this embodiment, so that it fulfills its function.

Referring more particularly to FIGS. 2A and 2B, it is noted that the assembly of base 20 and the blades of the female part is embedded in a matrix 75 of polymer, which has a housing 79 provided to receive head 32 of the contact-bearing casing and a bearing 78, peripheral to this housing, provided to receive and support o-ring 64.

The positioning of such a connection device for a male part with a female part, oriented perpendicularly, is indicated below.

In FIG. 2A, the male part is shown, which comprises socket 30 of the contact-bearing casing with a pair of contacts 36 on the inside. During mounting, the contacts are pushed toward head 32 of the contact-bearing casing until each of the contacts raise catch 46 projecting into socket 30 and then are locked onto the front of the latter. Catch 46 is found in straight position as shown in FIGS. 2A and 2B. The first locking means 44 is In place.

If one of the contacts should be placed out of position, which would result in a poor connection or even a non-connection of contact blades 37 of the male part with surface 24 of blades 18 of the female part, catch 46 remains raised, which puts it in the position shown in FIG. 5. It is noted that In this position the contacts do not abut and can be removed or pushed in freely.

In FIG. 2A, o-ring 64 is not pressed. It is noted, in contrast, that contact sealing joint 42 is active with regard to the contact-carrier, since it has been introduced simultaneously with the mounting of the contacts in socket 30.

In order to assure the final positioning of the connection, the two parts male 12 and female 10 are moved together and head 32 of the male part penetrates into housing 76 arranged in support matrix 75 of base 20. Simultaneously, blades 37 of contacts 36 slide onto either side of contact surface 24 of corresponding blade 18 of the female part.

Head 32 assures guiding relative to base 20.

Double locking is assured during this movement of approach and locking in.

Plate 50 comes to be supported on part 51 molded with the base, which has for an effect inducing the translation of this same plate and pushing it between catch 46 and the inner face of socket 30 of the contact-bearing casing, which assures the immobilization of the latter in the straight contact locking position. Part 51 also assures the insulation of the two blades 18 by forming a partition.

It is noted, as is visible in FIG. 5, that the mounting of the contact-bearing casing is rendered impossible when the contacts are not in position, since plate 50 comes to abut against catch 46, which is raised, which makes it impossible to move the male and female parts together. This eliminates cases of incorrect clicking in.

In FIG. 3, the female part in its matrix ready to receive the male part is shown in detail, surface view.

In FIG. 4, the respective position of the different elements during a correct clicking in is better understood. In this figure is also shown the mounting of attachment clamp 70, which, after pivoting around axle 72, is found elastically locked onto stud 74, thus assuring an elastic clamping of the male part onto the female part. As is also seen in FIG. 2B, o-ring 64 is then pressed to assure an appropriate seal.

What is claimed is:

1. Electrical connection device comprising:

a male part (12) comprising at least one first contact with elastic blades (37) forming an electrical connection clamp, positioned in a contact-bearing casing (28);

a female part (10) comprising at least one second contact (18) in the form of a blade, borne by a base, when the male and female parts are connected to each other said elastic blades of the first contact forming a clamp on both sides of the thickness of the corresponding blade of at least one second contact (18) of the female part, wherein the female part comprises a tubular part for receiving a nose part of the male part; and wherein the contact-bearing casing comprises a head with a receiving area for receiving a portion of the at least one second contact.

2. Electrical connection device according to claim 1, characterized in that the at least one second contact (18) is made up of a bare zone (21) of a metal strip elongated in a direction perpendicular to the axis of interlocking male part (12) into female part (10).

3. Electrical connection device according claim 2, further characterized in that, on either side of bare zone (21), the metal strip of the at least one second contact is inserted into an insulation base (20).

4. Electrical connection device according to claim 3, further characterized in that insulating base (20) is a molding, wherein said molding comprises a gap for containing the bare zone (21) of the metal strip.

5. Electrical connection device according to claim 4, further characterized in that the insulating base (20) and the metal strip form an over-molded single structure wherein said structure comprises the gap for containing the bare zone of the metal strip.

6. Electrical connection device according to claim 3, further characterized in that the female part comprises at least two metal strips (18), the two juxtaposed metal strips being separated from each other by an insulating partition (51) molded with insulating base (20).

7. Electrical connection device according to claim 1, characterized in that each blade of the at least one second contact (18) of the female part comprises a contact surface (24) defined by two transversal folds (22,22'), which allow an offsetting of said surface relative to the longitudinal axis of the base.

8. Electrical connection device according to claim 1, characterized in that the contact-bearing casing comprises first locking means (44) and second locking means (48) of male contacts (36) onto each corresponding blade (18) forming the female contacts.

9. Electrical connection device according to claim 1, characterized in that the female part comprises a matrix (75) in which an integrated assembly of base (20) and contacts (18) of the female part is positioned, said matrix comprising a housing (76) having an opposite profile of the male part for receiving the contact-bearing casing and tight sealing means of the male part.

10. Electrical connection device according to claim 8, further characterized in that tight sealing means comprise an o-ring (64) borne by male part (12) and provided in order to be pressed against a bearing (78) created in the imatrix.

11. Electrical connection device according to claim 9, further characterized in that the electrical conductor comprises clamping means (16) for holding the male part (12) and female part (10) in a mating arrangement.

12. An electrical connection device with a male part comprising:

at least one contact for electrical connection with elastic blades forming a clamp, positioned in a contact-bearing casing; and the male part interlocking into a female part; the female part comprising:

at least two juxtaposed contacts (18) in the form of a blade, borne by a base, the at least two juxtaposed contacts having a common insulation partition molded with the base, sa id elastic blades forming a clamp on both sides of the corresponding blades of the at least two juxtaposed contacts of the female part, each of said at least two juxtaposed contacts comprising:

a bare zone of a conducting s trip elongated in a direction perpendicular to the axis of the interlocking male part; and an insulating base for holding either side of the conducting strip.

13. An electrical connection device as in claim 12 wherein said elastic blades forming a clamp on both sides of the corresponding blades of the at least two juxtaposed contacts of the female part further comprises a clamp on both sides of the thickness of the corresponding blade of the at least two juxtaposed contacts (18) of the female part when the male and female parts are connected to each other.

14. An electrical connection device as in claim 12 wherein each juxtaposed contact further comprises a contact surface, the contact surface comprising two transversal folds.

15. An electrical connection device as in claim 12 wherein the contact-bearing casing comprises first locking means and second locking means of said elastic blades of the male part onto each corresponding blade of the female part when the male and female parts are connected to each other.

16. An electrical connection device as in claim 12 wherein the female part further comprises a matrix (75) in which an integrated assembly of the base (20) and the contacts (18) of the female part is positioned, said matrix comprising a housing (76) having an opposite profile of the male part for receiving the contact-bearing casing and a tight sealing means of the male part.

17. An electrical connection device as in claim 16 wherein the tight sealing means comprises an o-ring borne by the male part and provided in order to be pressed against a bearing created in the matrix when the male and female parts are connected to each other.

18. An electrical connection device as in claim 12 further characterized in that the electrical conductor comprises clamping means (16) for holding the male part (12) and female part (10) in a mating arrangement when the male and female parts are connected to each other.

19. An electrical connection device comprising:

a male part (12) comprising at least one first contact with elastic blades (37) forming an electrical connection clamp, positioned in a contact-bearing casing (28);

a female part (10) comprising at least one second contact (18) in the form of a blade, borne by a base, when the male and female parts are connected to each other said elastic blades of the first contact forming a clamp on both sides of the thickness of the corresponding blade of at least one second contact (18) of the female part; and a matrix, having the base and the at least two juxtaposed contacts integrally assembled within, the matrix further comprising a housing having an opposite profile for receiving the head of the contact-bearing casing and tight sealing means of the male part.

20. An electrical connection device according to claim 19 wherein the electrical connection device further comprises tight sealing means comprising an o-ring borne by male part and provided in order to be pressed against a bearing created in the matrix.

21. An electrical connection device according to claim 19 further characterized in that the electrical conductor comprises clamping means for holding the male part and female part in a mating arrangement.

* * * * *